US007055913B2

(12) United States Patent
Eickelmann et al.

(10) Patent No.: US 7,055,913 B2
(45) Date of Patent: Jun. 6, 2006

(54) CHAIN GUIDE ARRANGEMENT ON A MINING MACHINE

(75) Inventors: Reiner Eickelmann, Datteln (DE); Uwe Tillessen, Kamen (DE); Norbert Hesse, Bochum (DE); Gerhard Siepenkort, Lünen (DE); Klaus Duhnke, Bochum (DE); Adam Klabisch, Dortmund (DE)

(73) Assignee: DBT GmbH (DE)

( * ) Notice: Subject to any disclaimer, the term of this patent is extended or adjusted under 35 U.S.C. 154(b) by 0 days.

(21) Appl. No.: 11/038,742

(22) Filed: Jan. 20, 2005

(65) Prior Publication Data

US 2005/0156458 A1 Jul. 21, 2005

(30) Foreign Application Priority Data

Jan. 21, 2004 (DE) ..... 20 2004 000 924 U

(51) Int. Cl.
*E21C 27/34* (2006.01)
*E21C 29/14* (2006.01)

(52) U.S. Cl. ..... 299/34.07; 299/47

(58) Field of Classification Search ..... 299/34.01, 299/34.07, 47, 34.09; 474/111, 140
See application file for complete search history.

(56) References Cited

U.S. PATENT DOCUMENTS 1,348,240 A * 8/1920 Pieper et al. ..... 474/140
1,758,246 A * 5/1930 Brackett et al. ..... 474/140
5,184,873 A * 2/1993 Fiesel ..... 299/43
6,013,000 A * 1/2000 Moretz ..... 474/111

FOREIGN PATENT DOCUMENTS

DE 1811 009 7/1970
DE 201 06 732 U1 8/2001

* cited by examiner

*Primary Examiner*—John Kreck
(74) *Attorney, Agent, or Firm*—Fay, Sharpe, Fagan, Minnich & McKee, LLP

(57) ABSTRACT

Chain guide arrangement for a mining machine, in particular for an extraction plough. The chain guide arrangement comprises a first chain passage for a load strand and a second chain passage for a return strand of a drive chain of the mining machine. At the end areas of the chain passages there are provided a drive station and a return station for the drive chain. At least at one of the chain passages a chain guide for the load strand and/or for the return strand of the drive chain is provided in a transition area to the drive station/s and/or the return station. According to the invention, the chain guide comprises a retaining pocket being open towards the drive chain and at an end face thereof being bounded by a hinge pin arranged to be transverse to a direction of movement of the chain. The chain guide further comprises a hold-down device comprising a pin seating on at least its one end face which pin seating matches with the hinge pin and is open on one side, and a locking arrangement. The hold-down device comprises a pressure face adjoining against the drive chain when the hold-down device is in a state in which it is retained in the retaining pocket and locked.

16 Claims, 3 Drawing Sheets

CHAIN GUIDE ARRANGEMENT ON A MINING MACHINE

The invention relates to a chain guide arrangement for a mining machine, in particular a plough chain guide arrangement for an extraction plough, with a first chain passage for the load strand and a second chain passage for the return strand of the drive chain of the mining machine, at the end areas of which there are provided at least one drive station and/or one return station comprising drive or guide sprocket wheels respectively for the drive chain, whereat in at least one of the chain passages in a transition area to the drive station/s and/or the return station a chain guide is fitted for the load strand of the chain and/or for the return strand.

A drive station for a chain scraper conveyor or a coal plough is known from DE 1 811 009 A, in which for the guidance of the drive chain in the transition area to the channel sections of the conveyor, or the plough guide of the coal plough, the chain is guided by means of an approximately wedge-shaped drive frame which comprises an essentially plane first guide track and an inclined second guide track that is arranged to be at an acute angle to the former, against which the strands of the drive chain under load and not under load adjoin immediately before and after their revolution around the chain drum of the drive station.

A chain guide arrangement of like kind is known from DE 201 06 732 U, in which the chain guide consists essentially of a guide shoe that is arranged to be in a fixed position in the inlet or outlet area of the second chain passage for the load strand of the chain. The known arrangement has basically proved itself to be reliable, but after a certain operating time of the plough causes problems, since as a result of continuous contact with the return strand of the chain the guide shoe is subject to a large amount of wear, and can only be removed and changed for a new guide shoe at great expense.

SUMMARY OF THE INVENTION

The object of the invention is to create a chain guide arrangement of the above identified kind that takes into account the requirements arising as a result of the large amount of wear in the area of the chain guide, and in which it is possible to replace the part that is most subject to wear within a shortest possible time, thus limiting the downtime of the mining machine to a minimum.

This object is achieved with the invention in that the chain guide comprises a retaining pocket being open towards the drive chain and being bounded by a hinge pin at one front face, said hinge pin being arranged to be transverse to the direction of movement of the chain, said chain guide further comprising a hold-down device, said hold-down device at least on its one end face being provided with a pin seating matching with the hinge pin and open at one side, and also being provided with a locking arrangement, said hold-down device on its bottom side further comprising a pressure face adjoining against the drive chain when the hold-down device is in a state in which it is retained in the retaining pocket and locked.

In accordance with the invention, the guidance of the chain is basically achieved by the hold-down device that is inserted and locked in the retaining pocket provided for it. Insertion of the hold-down device into the retaining pocket is achieved in a particularly simple and rapid manner in that it is placed onto the hinge pin with its pin seating which is open at one side, preferably at a front face, and is then swivelled downwards around the latter until its lower pressure face presses against the drive chain and can be locked in this location with its locking arrangement. The removal of the hold-down device is performed in a similarly simple and rapid manner, in that firstly the locking arrangement is released and the hold-down device is then swivelled upwards around the hinge pin until it can be pulled away from the latter and exchanged for a new hold-down device.

The lower pressure face is preferably configured as a wear face and for this purpose can be provided with an exchangeable wear plate. The locking arrangement preferably consists essentially of a locking hole in the hold-down device transverse to the direction of movement of the chain, which in the locked state is penetrated by a locking pin that is pushed through bolt holes that are located in the retaining flanges that laterally define the retaining pocket. For locking of the hold-down device the latter is thus swivelled into the retaining pocket until its locking hole aligns with the two bolt holes in the retaining flanges of the retaining pocket, so that the locking pin can then be pushed transversely through all three openings.

The hold-down device preferably is provided on its upper side with a handle that can be gripped so that it can easily be carried and inserted into the retaining pocket. The handle can have a gripping hollow on the upper side of the hold-down device as well as a hand grip that spans across the gripping hollow, preferably parallel to the direction of movement of the chain.

In a preferred embodiment of the invention, the hold-down device comprises a lateral guide element co-acting with a mounting for the guide element, said mounting being arranged at the retaining pocket, to provide lateral guidance or positioning of the guide element. The lateral guide element can be formed by a peg or the like, projecting from the other end face that faces away from the pin seating, whereas a particularly simple design is achieved if the peg is formed from a projecting end of the hand grip.

In an advantageous configuration of the invention the chain guide is located in immediate spatial proximity to its chain-tensioning device, with the help of which the chain can be secured if an exchange of the chain guide is required.

BRIEF DESCRIPTION OF DRAWINGS

Further features and advantages of the invention will become apparent from the following description and the drawings, wherein a preferred embodiment of the invention is explained in more detail with an example. It shows.

DETAILED DESCRIPTION OF PREFERRED EMBODIMENTS

Figure 1:
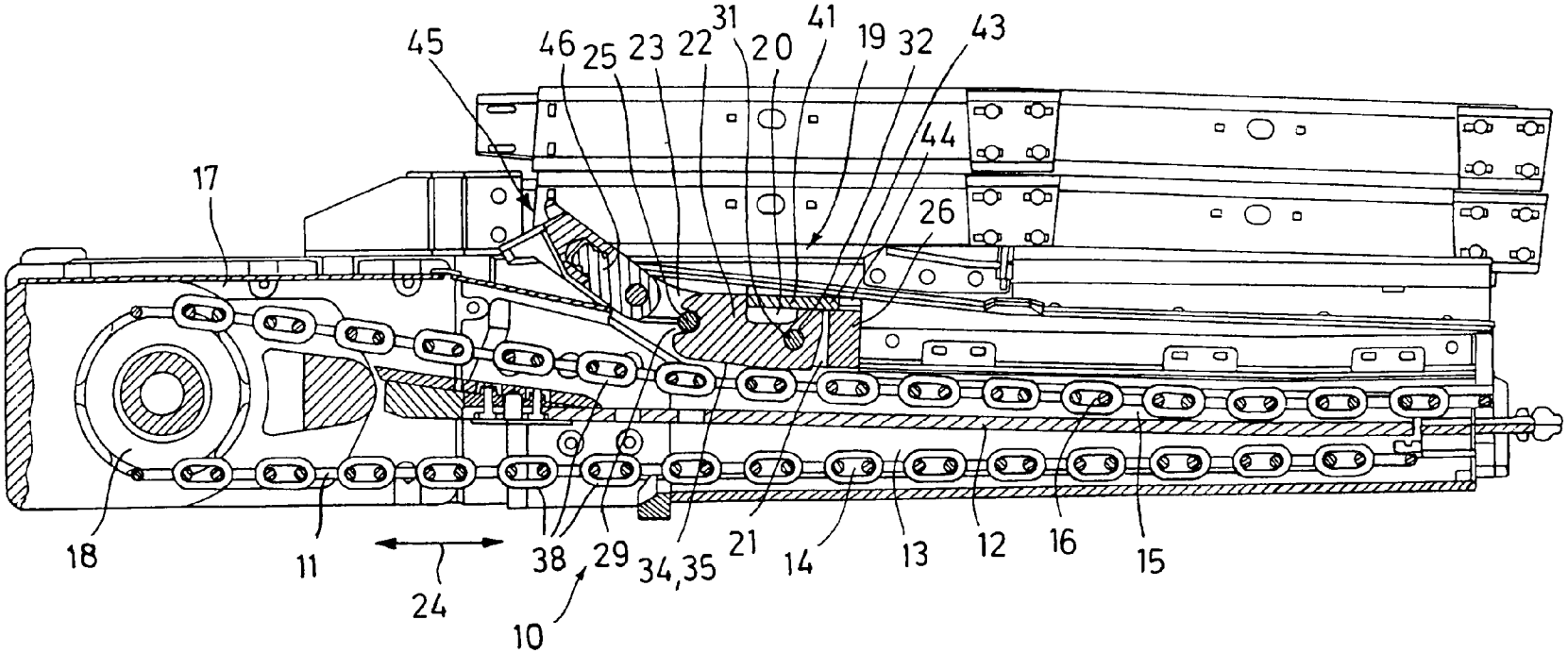
FIG. 1 a longitudinal section of a chain guide arrangement for a coal plough in accordance with the invention.

The chain guide arrangement identified in the drawing in its entirety by 10 serves for the guidance of a drive chain 11 for an extraction plough, as it is deployed for the extraction of coal in underground mining.

The chain guide arrangement 10 exhibits, in a plough guide 12, a first chain passage 13 for the load strand 14 of the chain and a second chain passage 15 that accommodates the return strand 16 of the chain. At the end areas of the chain passages 13 and 15 a drive station 17 is provided having a drive chain wheel 18 around which the drive chain 11 is wound and with which the chain is pulled through the chain passages, as this is known. In the transition area 19 between the second chain passage 15 and the drive station 17 a chain guide 20 is fitted for the return strand 16 of the drive chain 11, which chain guide essentially consists of a retaining pocket 21, open on its top and bottom, and a hold-down device 22 that is inserted into the former and retained in its inserted position. On its end face 23 facing towards the drive station 17, the retaining pocket 21 is bounded by a hinge pin 25 positioned in a transverse orientation with respect to the direction of movement 24 of the drive chain 11. On the rearward end face, which is thus facing away from the hinge pin, the retaining pocket is bounded by a bearing block 26. Laterally the retaining pocket 21 is bounded by two retaining flanges 27, which in their areas bordering the bearing block 26 are provided with bolt holes 28.

At its forward end facing towards the drive station 17, the hold-down device 22 is provided with a grooved type of pin seating, open on its front face, which in cross-section is approximately U-shaped and which, with its semi-circular in cross-section grooved base 30 is adapted to the shape and the diameter of the hinge pin 25. In its rearwards area, i.e. the area that is facing away from the drive station 17, the hold-down device 22 is provided with a locking arrangement in the form of a locking hole 31, which runs transverse to the direction of movement 24 of the drive chain 11, and which aligns with the two bolt holes 28 in the retaining flanges 27 when the hold-down device is in the state in which it has been inserted into the retaining pocket 21 and pressed down against the return strand 16 of the drive chain (FIG. 1). For retention of the hold-down device 22 in this operating position, a locking pin 31 is inserted from the outer side of one of the two retaining flanges through the bolt holes 28 and the locking hole 31 and secured in the inserted location by means of a securing peg 33.

The hold-down device on its bottom side 34 comprises a pressure face 35 that is provided with an exchangeable wear plate 36. The wear plate can consist of hard metal, a high wear resistance plastic, or another suitable material, and can be screwed against the underside 34 of the hold-down device, or secured in another suitable manner, for example, by brazing. The pressure face 35 or the wear plate 36 is divided into two parts in the longitudinal direction of the hold-down device 22, whereas between the two parts of the wear plate a grooved joint 37 is defined. In the operating state as shown in FIG. 1 and FIG. 2, in which the hold-down device has been accommodated in the retaining pocket and locked, the pressure face 35 with its wear plate 36 is adjoining against the drive chain 11.

On its upper side 39, the hold-down device 22 comprises a handle 40 with a hand grip 41 which runs parallel to the direction of movement 24 of the chain, and providing a grip hollow 42 formed under the hand grip. With the handle, the hold-down device can easily be grasped with one hand and inserted into or lifted out of the retaining pocket. For the exchange of a hold-down device, the locking pin 32 is firstly removed, so that the hold-down device can then be grasped with one hand by the hand grip 41 and swivelled upwards around the hinge pin 25 and removed outwards from the hinge pin. A new hold-down device, on which the pressure face or wear plate is not yet worn, is then inserted and locked into the retaining pocket in the reversed sequence. It can be recognised from the drawings that the hand grip 41 projects beyond the rearward end of the hold-down device and with its projecting pin 43 forms a lateral guide element, which with the introduction of the hold-down device into the retaining pocket registers with a guide element seating 44 located on top of the bearing block 26, and thus provides lateral guidance for the hold-down device.

Figure 2:
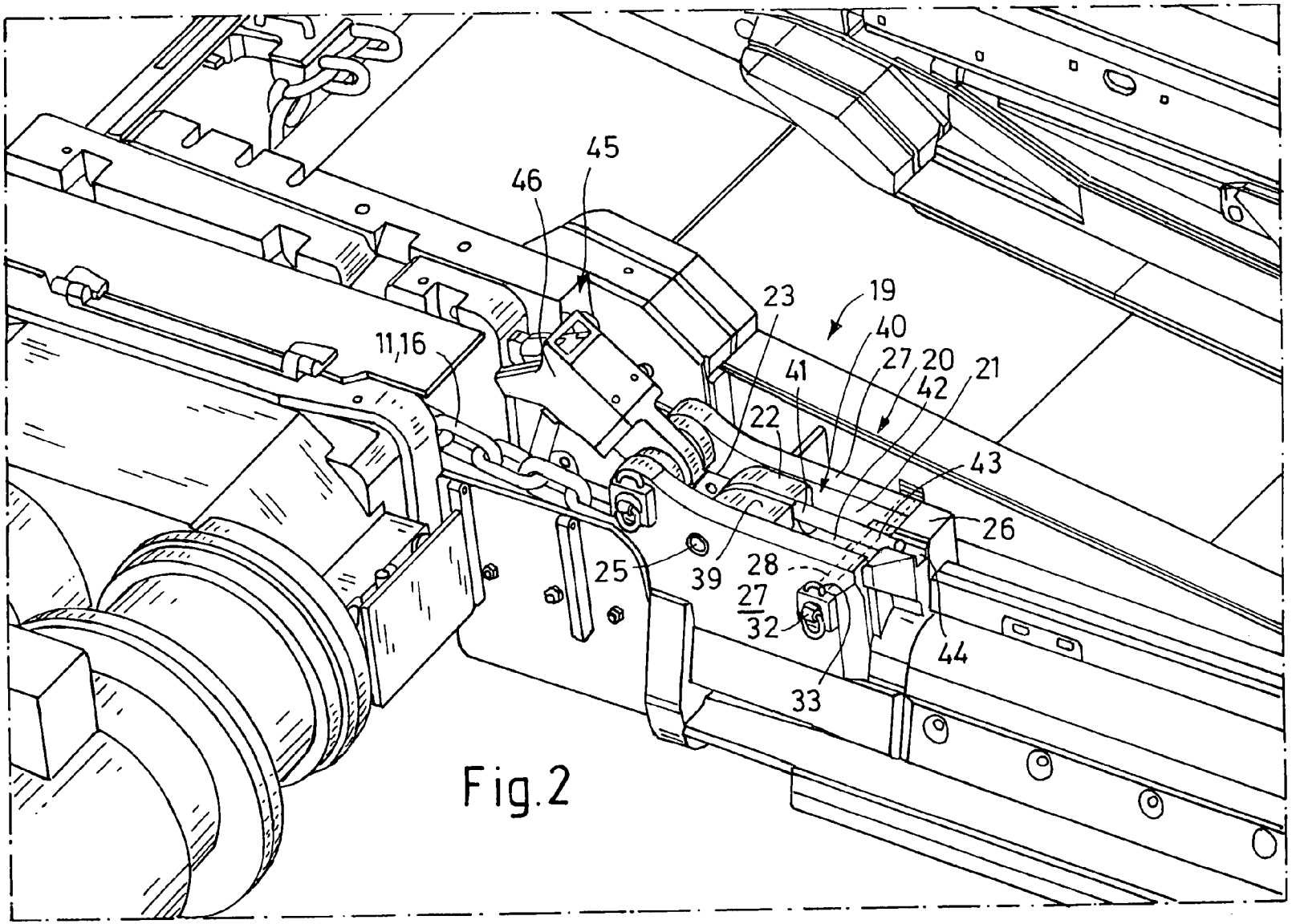
FIG. 2 the chain guide arrangement of FIG. 1 in the area of the chain guide in an oblique perspective view from above.
Figure 3:
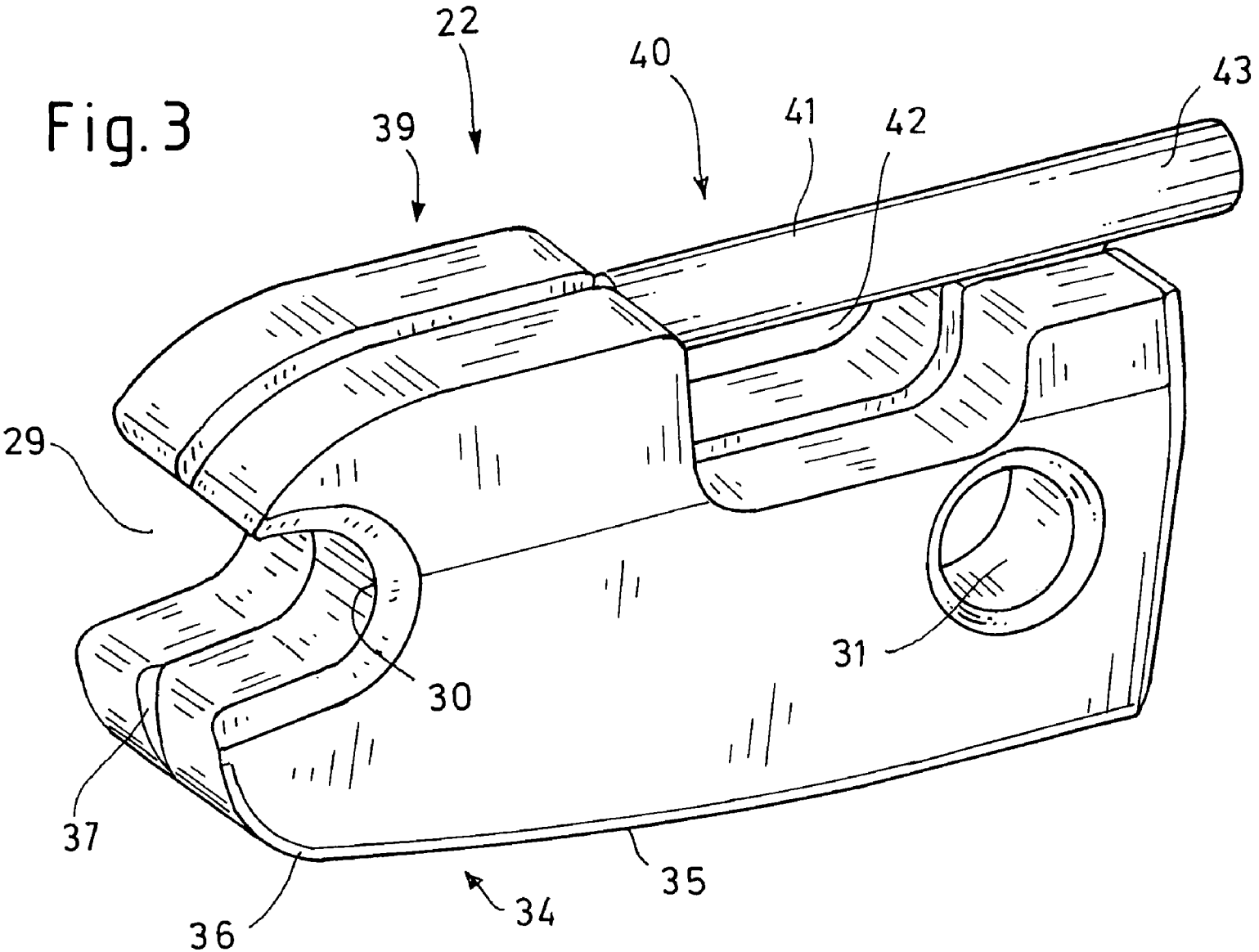
FIG. 3 the hold-down device of the chain guide of the invention in a perspective view.

It can further be recognised from FIGS. 1 and 2 that the chain guide 20 is located in the immediate spatial vicinity of a chain-tensioning device 45, which essentially comprises a swivelling tensioning shoe 46 that is disposed between the two retaining flanges, and which is swivelled down on to the drive chain before the exchange of the hold-down device, and in this manner secures the length of the chain not under load while the hold-down device is being replaced.

The invention is not limited to the embodiment as illustrated and described above, but rather a series of modifications and enhancements can be envisaged without leaving the scope of the invention. Thus it is, for example, possible to arrange a chain guide according to the invention also or alternatively on the length of the drive chain under load.

The invention claimed is:

1. Chain guide arrangement for a mining machine, in particular a plough chain guide arrangement for an extraction plough, said chain guide arrangement comprising a first chain passage for a load strand and a second chain passage for a return strand of a drive chain of said mining machine, at the end areas of which there are provided at least one drive station and/or one return station for said drive chain, said drive station and/or return station comprising drive or guide sprocket wheels, respectively, for said drive chain, whereat at least at one of said chain passages a chain guide for said load strand and/or for said return strand of the drive chain is provided in a transition area to said drive station/s and/or said return station, wherein said chain guide comprises a retaining pocket being open towards said drive chain and at an end face thereof being bounded by a hinge pin arranged to be transverse to a direction of movement of said chain, said chain guide further comprising a hold-down device comprising a pin seating on at least its one end face, said pin seating matching with said hinge pin and is open on one side, and a locking arrangement, said hold-down device comprising a pressure face adjoining against said drive chain when said hold-down device is in a state in which it is retained in said retaining pocket and locked.

2. Chain guide arrangement according to claim 1, wherein said pressure face is configured as a wear face.

3. Chain guide arrangement according to claim 1, wherein said pressure face is provided with an exchangeable wear plate.

4. Chain guide arrangement according to claim 1, wherein said hold-down device is made from high strength steel, preferably of St 120 Mn quality.

5. Chain guide arrangement according to claim 1, wherein said hold-down device comprises a cast part.

6. Chain guide arrangement according to claim 1, wherein said hold-down device comprises a forged part.

7. Chain guide arrangement according to claim 1, wherein said hold-down device comprises two similar flame-cut parts, which are welded together in the area of a grooved joint.

8. Chain guide arrangement according to claim 1, wherein said locking arrangement comprises a locking hole in said hold-down device running transverse to said direction of movement of said drive chain, which in the locked state is penetrated by a locking pin that is inserted through bolt holes in retaining flanges which laterally bound said retaining pocket (21).

9. Chain guide arrangement according to claim 1, wherein said hold-down device on its upper side is provided with a handle that can be gripped.

10. Chain guide arrangement according to claim 8, wherein said hold-down device on its upper side is provided with a handle that can be gripped.

11. Chain guide arrangement according to claim 9, wherein said handle comprises a gripping hollow formed on said upper side of said hold-down device, and also a hand grip spanning said gripping hollow and preferably running parallel to said direction of movement of said chain.

12. Chain guide arrangement according to claim 10, wherein said handle comprises a gripping hollow formed on said upper side of said hold-down device, and also a hand grip spanning said gripping hollow and preferably running parallel to said direction of movement of said chain.

13. Chain guide arrangement according to claim 1, wherein said hold-down device comprises a lateral guide element, which, to provide lateral guidance or positioning in said retaining pocket, co-acts with a guide element seating located on the latter.

14. Chain guide arrangement according to claim 13, wherein said lateral guide element is formed by a pin or similar, projecting from an other end face facing away from said pin seating.

15. Chain guide device according to claim 14, wherein said pin is formed from a projecting end of said hand grip.

16. Chain guide arrangement according to claim 1, wherein said chain guide is arranged to be in immediate spatial vicinity of a chain-tensioning device.

* * * * *